US009169636B2

(12) United States Patent
Blank

(10) Patent No.: US 9,169,636 B2
(45) Date of Patent: Oct. 27, 2015

(54) SYSTEM FOR CONTROLLING BASEMENT LEAKAGE AND HUMIDITY

(76) Inventor: James D. Blank, Batavia, OH (US)

( * ) Notice: Subject to any disclaimer, the term of this patent is extended or adjusted under 35 U.S.C. 154(b) by 419 days.

(21) Appl. No.: 13/548,335

(22) Filed: Jul. 13, 2012

(65) Prior Publication Data

US 2013/0014447 A1 Jan. 17, 2013

Related U.S. Application Data

(60) Provisional application No. 61/507,857, filed on Jul. 14, 2011.

(51) Int. Cl.
*E02D 31/02* (2006.01)
*E04B 1/70* (2006.01)
*F24F 13/22* (2006.01)

(52) U.S. Cl.
CPC ..... *E04B 1/7023* (2013.01); *E02D 31/02* (2013.01); *F24F 2013/221* (2013.01)

(58) Field of Classification Search
CPC ..... E04B 1/7023; E04B 1/7069; F24F 2013/221; E02D 31/02
USPC ..... 52/169.5, 302.3, 302.4; 417/14, 18, 36; 137/312, 357, 360, 362
See application file for complete search history.

(56) References Cited

U.S. PATENT DOCUMENTS 964,942 A * 7/1910 Smith ..... 52/302.4
1,745,765 A * 2/1930 Lucas ..... 237/46
1,746,816 A * 2/1930 Boes ..... 52/607
1,891,934 A * 12/1932 Joy et al. ..... 52/274
1,979,127 A * 10/1934 Warrick ..... 361/209
2,013,367 A * 9/1935 Thompson ..... 52/289
2,147,035 A * 2/1939 Henderson ..... 52/293.2
2,329,585 A * 9/1943 Brewer ..... 52/302.4
2,464,491 A * 3/1949 Davis ..... 52/264
2,703,002 A * 3/1955 Suskind ..... 52/302.3
2,717,513 A 9/1955 Smart
3,170,269 A * 2/1965 Dunnington ..... 52/293.3
3,287,866 A * 11/1966 Bevilacqua ..... 52/169.5
3,304,672 A 2/1967 Bakke
3,337,778 A * 8/1967 Becker ..... 361/142

(Continued)

FOREIGN PATENT DOCUMENTS

AT 279495 B * 3/1970
DE 3802921 A1 * 8/1989 ..... E04B 1/70

(Continued)

*Primary Examiner* — James Ference
*Assistant Examiner* — Charissa Ahmad
(74) *Attorney, Agent, or Firm* — Hasse & Nesbitt LLC; Daniel F. Nesbitt

(57) ABSTRACT

A system for controlling water leakage and excess humidity in a basement, including a water leakage vacuum apparatus that includes a water vacuuming apparatus to collect a water leakage through a basement wall, an air dehumidifying apparatus, and a perimeter channel system having a plurality of flow channels, disposed along the perimeter of the basement wall. The perimeter channel system includes a water channel for conducting the water leakage away from a basement wall to the water vacuuming apparatus, a humid air channel for communicating humid air from the air space proximate to the outer wall of the basement to a dehumidifying apparatus, and a dehumidified air channel for communicating the dehumidified air discharged from the dehumidifying apparatus to the air space proximate to the outer wall of the basement.

17 Claims, 18 Drawing Sheets

(56) References Cited

U.S. PATENT DOCUMENTS

| | | | | | |
|---|---|---|---|---|---|
| 3,344,569 | A | | 10/1967 | Cotten | |
| 3,426,487 | A | * | 2/1969 | Forte | 52/1 |
| 3,852,925 | A | | 12/1974 | Gazzo | |
| 3,975,467 | A | | 8/1976 | Beck | |
| 4,057,366 | A | * | 11/1977 | Niemann | 417/234 |
| 4,075,800 | A | | 2/1978 | Molick | |
| 4,136,500 | A | * | 1/1979 | DiFiore | 52/741.13 |
| 4,265,064 | A | | 5/1981 | Parezo | |
| 4,295,415 | A | * | 10/1981 | Schneider, Jr. | 454/185 |
| 4,461,614 | A | * | 7/1984 | Niedermeyer | 417/423.9 |
| 4,528,787 | A | * | 7/1985 | Rittinge | 52/169.5 |
| 4,578,912 | A | * | 4/1986 | Ericsson | 52/169.5 |
| 4,621,470 | A | * | 11/1986 | Balinski | 52/241 |
| 4,798,034 | A | | 1/1989 | Jarnagin et al. | |
| 4,843,786 | A | * | 7/1989 | Walkinshaw et al. | 52/169.5 |
| 4,957,394 | A | * | 9/1990 | Jarnagin et al. | 405/229 |
| 5,184,437 | A | * | 2/1993 | Woong et al. | 52/169.5 |
| 5,199,232 | A | | 4/1993 | Chandler et al. | |
| 5,274,968 | A | * | 1/1994 | Pardo | 52/97 |
| 5,277,003 | A | | 1/1994 | Myers | |
| 5,356,240 | A | * | 10/1994 | Schuler | 405/229 |
| 5,399,050 | A | * | 3/1995 | Jacobus | 405/229 |
| 5,535,556 | A | * | 7/1996 | Hughes, Jr. | 52/169.5 |
| 5,768,842 | A | * | 6/1998 | Austin | 52/302.3 |
| 5,845,456 | A | | 12/1998 | Read | |
| 5,923,102 | A | * | 7/1999 | Koenig et al. | 307/118 |
| 6,254,350 | B1 | * | 7/2001 | Koenig et al. | 417/36 |
| 6,332,326 | B1 | * | 12/2001 | Shim | 62/93 |
| 6,447,261 | B1 | * | 9/2002 | McCook | 417/234 |
| 6,567,769 | B2 | * | 5/2003 | Chang | 702/188 |
| 6,646,564 | B1 | * | 11/2003 | Azieres et al. | 340/679 |
| 6,742,758 | B2 | * | 6/2004 | Janesky | 249/7 |
| 6,792,725 | B1 | * | 9/2004 | Rutherford | 52/209 |
| 6,904,723 | B1 | * | 6/2005 | Moore et al. | 52/169.5 |
| 7,143,558 | B2 | | 12/2006 | Trotter | |
| 7,243,050 | B2 | | 7/2007 | Armstrong | |
| 7,403,126 | B2 | * | 7/2008 | Pedraza et al. | 340/604 |
| 7,562,509 | B2 | * | 7/2009 | Ness | 52/800.11 |
| 7,641,593 | B2 | * | 1/2010 | Goulet | 482/15 |
| 7,832,156 | B2 | | 11/2010 | Trotter | |
| 7,918,061 | B2 | * | 4/2011 | Jackson et al. | 52/302.3 |
| D644,339 | S | * | 8/2011 | Sutton | D25/121 |
| 8,109,045 | B2 | * | 2/2012 | Kliefoth et al. | 52/169.5 |
| 8,297,015 | B2 | * | 10/2012 | Martin | 52/302.1 |
| 2001/0023564 | A1 | * | 9/2001 | Phillips | 52/302.1 |
| 2002/0073628 | A1 | * | 6/2002 | Dextras | 52/1 |
| 2002/0176782 | A1 | * | 11/2002 | Batchelder et al. | 417/36 |
| 2003/0200707 | A1 | * | 10/2003 | Parker | 52/169.5 |
| 2006/0026911 | A1 | * | 2/2006 | Sutton | 52/169.5 |
| 2007/0101663 | A1 | * | 5/2007 | Aubut | 52/169.5 |
| 2007/0294966 | A1 | * | 12/2007 | Andras | 52/169.5 |
| 2010/0319296 | A1 | * | 12/2010 | Trotter | 52/741.3 |

FOREIGN PATENT DOCUMENTS

| | | | | | |
|---|---|---|---|---|---|
| GB | 1057642 | A | * | 2/1967 | |
| GB | 2169071 | A | * | 7/1986 | F24F 7/00 |
| WO | WO 8200312 | A1 | * | 2/1982 | E04B 1/70 |

* cited by examiner

SYSTEM FOR CONTROLLING BASEMENT LEAKAGE AND HUMIDITY

CROSS-REFERENCE TO RELATED APPLICATION

This application claims the benefit of U.S. Provisional Application No. 61/507,857, filed on Jul. 14, 2011, the disclosure of which is incorporated herein by reference.

BACKGROUND OF THE INVENTION

The foundations of buildings often experience water problems due to a variety of causes. When such foundations are constructed, the surrounding soil must be removed prior to construction and then replaced after the foundation is completed. As a result, foundations can become damaged as soil settles outside of the foundation. Furthermore, a negative grade sloping toward the foundation is also often formed due to such settling. With the negative grade, the force of gravity causes water to move toward the foundation cracking the foundation and eventually entering into the building. This is especially true of basements and crawl spaces.

When water enters a dwelling, many problems arise, both to the physical structure of the dwelling and to the air. It is known in the art to install structural waterproofing systems to drain water from basements and crawl spaces. Typical waterproofing systems include some method of draining the water from inside the building to the outside. U.S. Pat. No. 4,798,034 discloses a basement draining channel that extends around the periphery of a basement floor, next to the wall, for draining away collected water. The channel includes a plurality of drain entrance holes leading to drain tubes. When water enters the basement walls, it is collected in the channel and directed toward the entrance holes due to gravity. The water is channeled via gravity to a drain connector pipe to a sump pump. The problem with such existing gravity-based waterproofing systems, however, is that the system must absorb a certain amount of water before the water will flow, and ultimately drain from the structure. If there is too little water to cause flow, the water remains stagnant and may evaporate back into the interior of the basement causing mildew, mold, and general dampness. Also when a sufficient amount of water is present to create a flow, a residual amount of water is left in the conduit when the flow stops. Additionally, any water drained directly beneath the floor of the basement may evaporate back into the waterproofing system and eventually back into the basement. Dampness and associated mold from such evaporation causes damage to buildings, ruins possessions, produces foul odors, and even presents potential health problems. When excessive moisture or water accumulates indoors, growing molds produce allergens, irritants, and potentially toxic substances. Although mold growth can be treated, it cannot be eliminated as long as a moisture problem exists.

Thus, there remains a need in the art for a system for handling water leakage and resulting humidity in a basement and other room of a building or structure.

SUMMARY OF THE INVENTION

An aspect of the present invention is a system and method for controlling water leakage and excess humidity in living, working and storage spaces of homes and other buildings including offices, apartments and hotel rooms, including at-grade, above-grade and below-grade levels and floors, and in particularly in basements and more particularly finished basements.

An aspect of the present invention is a system and method for controlling water leakage and excess humidity in basements, and more particularly in finished basements, that do not have sub-floor sump for collecting and discharging water that leaks into the basement.

An aspect of the present invention is a system and method of channeling water that leaks into living, working and storage spaces of homes and other buildings including offices, apartments and hotel rooms, including at-grade, above-grade and below-grade levels and floors, into the air and floor space between two walls of the building.

Another aspect of the present invention is a system and method of channeling water that leaks into a basement, or into the space between two walls of a building, to a sump for collection and discharge from the basement or the building.

An aspect of the present invention is a system and method for controlling the humidity in a basement or between two walls of a building, including the air space between the outer wall of the basement and the fabricated interior wall of a finished or remodeled basement area.

An aspect of the present invention is a system and method for dehumidifying the air in a basement or building, and more particularly the air between the outer walls of a basement and the fabricated interior wall of a finished or remodeled basement area, or in the air space between two walls of a building.

An aspect of the present invention is a system and method for detecting water leakage and the humidity conditions of the air in a basement, or into the space between two walls of a building, and more particularly water leakage and the humidity condition of the air between the outer walls of a basement and the fabricated interior wall of a finished or remodeled basement area.

An aspect of the present invention is a water and air channeling device, a system and a method that includes at least one channel for conducting water leakage away from a basement wall or the space between two walls of the building, and at least one channel for conducting dehumidified air toward the basement wall or into the space between two walls of the building.

An aspect of the present invention is a vacuum system and a method that includes a water vacuuming apparatus and an above-floor sump to collect and discharge water leakage.

In a further aspect of the present invention, the vacuum system and the method can further include a pumping device for discharging the collected water leakage to outside of the basement or outside the building.

An aspect of the present invention is a system and a method using a water and air channeling device for positioning drywall and finished wall panels up from and off of the basement floor, or the floor of a building.

An aspect of the present invention is a water leakage control and air dehumidifying system and a method that includes a perimeter channel system having a plurality of flow channels, secured to the floor of a basement proximate the outer wall, or between two walls of a building, and including a water channel for communicating water leakage away from at least one wall of the basement, or between the two walls, to a sump; a humid air channel for communicating humid air from the air space proximate to the outer wall of the basement to an air dehumidifying apparatus, or between the two walls; and a dehumidified air channel for communicating the dehumidified air from the air dehumidifying apparatus to the air space proximate to the outer wall of the basement, or between the two walls.

In a further aspect of the present invention, the water leakage control and air dehumidifying system and the method that further includes a water leakage detecting and control system for detecting water leakage into one or more locations along the perimeter channel system, and controlling the water vacuuming apparatus and system.

Another aspect of the present invention is a modular water leakage control and air dehumidifying apparatus that includes: an air dehumidifying apparatus having a humid air inlet and a dehumidified air outlet; an air channel manifold, wherein the air channel manifold includes a humid air channel in air communication between the humid air inlet of the air dehumidifying apparatus and a humid air inlet port, and a dehumidified channel in air communication between the dehumidified air outlet of the air dehumidifying apparatus and a dehumidified air outlet port; a water vacuuming apparatus having a vacuum inlet; and a water channel manifold that includes a water channel in fluid (water and/or air) communication between the vacuum inlet and a vacuum inlet port.

In a further aspect of the present invention, the water leakage detecting and control system includes a means for limiting entry of water leakage into the perimeter channel system to the one or more locations where water leakage has been detected.

In a further aspect of the present invention, the water leakage control and air dehumidifying system further includes a humidity detecting and control system for detecting the humidity of the air in a space proximate the basement wall, at one or more locations along the perimeter channel system, and for drawing, dehumidifying and returning the air.

In a further aspect of the present invention, the water leakage control and air dehumidifying system and the method further include a control and network system for monitoring, programming, controlling the water leakage control and air humidifying system, and for collecting and recording data on water leakage and air humidity, from a remote location from the residence or building of the office, room, or basement, typically utilizing the internet.

In a further aspect of the present invention, the water leakage control and air dehumidifying system and the method further include an electrical power backup, including battery power backup.

The present invention provides a system for controlling water leakage and excess humidity in a basement, including: a. a water leakage vacuum apparatus that includes a water vacuuming apparatus to collect a water leakage through a basement wall, b. an air dehumidifying apparatus, and c. a perimeter channel system having a plurality of flow channels, disposed along the perimeter of the basement wall, the perimeter channel system including a water channel for conducting the water leakage away from a basement wall to the water vacuuming apparatus, a humid air channel for communicating humid air from the air space proximate to the outer wall of the basement to a dehumidifying apparatus, and a dehumidified air channel for communicating the dehumidified air discharged from the dehumidifying apparatus to the air space proximate to the outer wall of the basement. The system can further include a water leakage detector positioned along the basement floor along the perimeter, and between the basement wall and a portion of the water and air channeling device, for detecting the water leakage, and communicating a signal to the water leakage vacuum apparatus.

The present invention also provides a system for controlling water leakage and excess humidity in the space between two walls of a building, including: a. a water leakage vacuum apparatus that includes a water vacuuming apparatus to collect a water leakage into a space between two walls of a building, b. an air dehumidifying apparatus, and c. a perimeter channel system having a plurality of flow channels, disposed within the space between the two walls, the perimeter channel system including a water channel for conducting the water leakage away from the space between the two walls to the water vacuuming apparatus, a humid air channel for communicating humid air from the air space between the two walls to a dehumidifying apparatus, and a dehumidified air channel for communicating the dehumidified air discharged from the dehumidifying apparatus to the air space between the two walls. The system can further include a water leakage detector positioned along the floor of the space between the two walls, and between one of the two walls and a portion of the water and air channeling device, for detecting the water leakage, and communicating a signal to the water leakage vacuum apparatus.

DETAILED DESCRIPTION OF THE INVENTION

Figure 1:
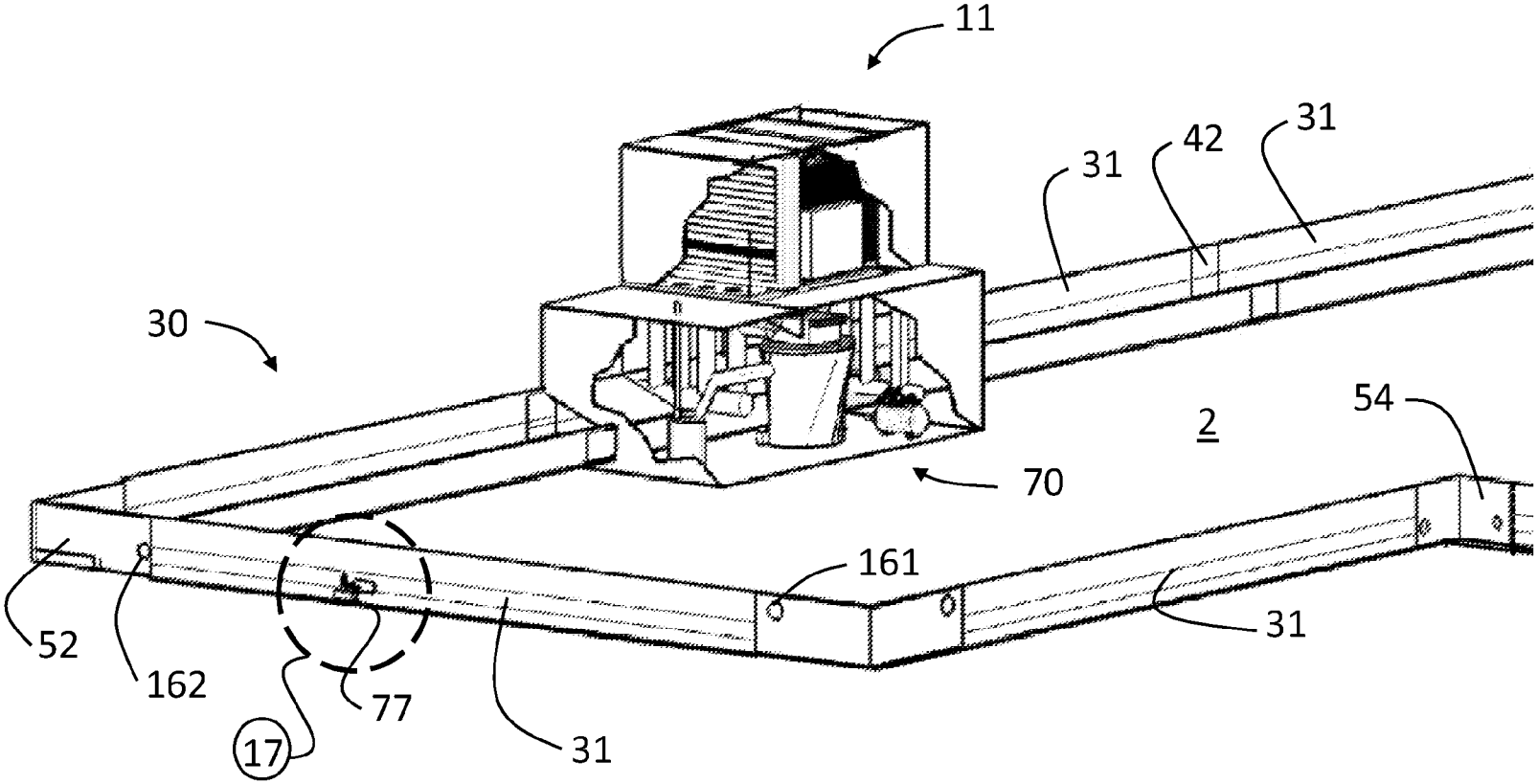
FIG. 1 shows a water leakage control and air dehumidifying system of the present invention, including a module containing an air dehumidifying apparatus and a water vacuuming apparatus and a water and air channeling device.

The present invention is described hereinafter in embodiments of additional detail, related to a system and method for controlling water leakage and/or excess humidity in living, working and storage spaces of homes and other buildings including offices, apartments and hotel rooms, including at-grade, above-grade and below-grade levels and floors. Illustrations of such systems and methods are provided hereinafter with respect to basements and more particularly finished basements, but is in no way limited to such structures.

<<The General Layout of the System>

An embodiment of a water leakage control and air dehumidifying system of the present invention installed into a basement is shown in FIGS. 1, 2A, 2B and 3. The basement 1 is illustrated as a sub-grade basement that includes a substantially flat and planar basement floor 2, typically of poured concrete, and a basement wall 3, typically of poured concrete, cinder block, or stone, mounted on a footer 6 with an inner wall surface 8 facing the basement interior and an outer wall surface restraining the earthen soil 4.

A modular unit 11 containing a water vacuuming apparatus 70 and an air dehumidifying apparatus 14 is connected by fluid-conducting piping or tubing a water and air channeling track system 30, which is positioned proximate the perimeter of the basement wall 3, spaced a short distance from the inner wall 8.

<<The Water and Air Channeling Track System>

Figure 2A:
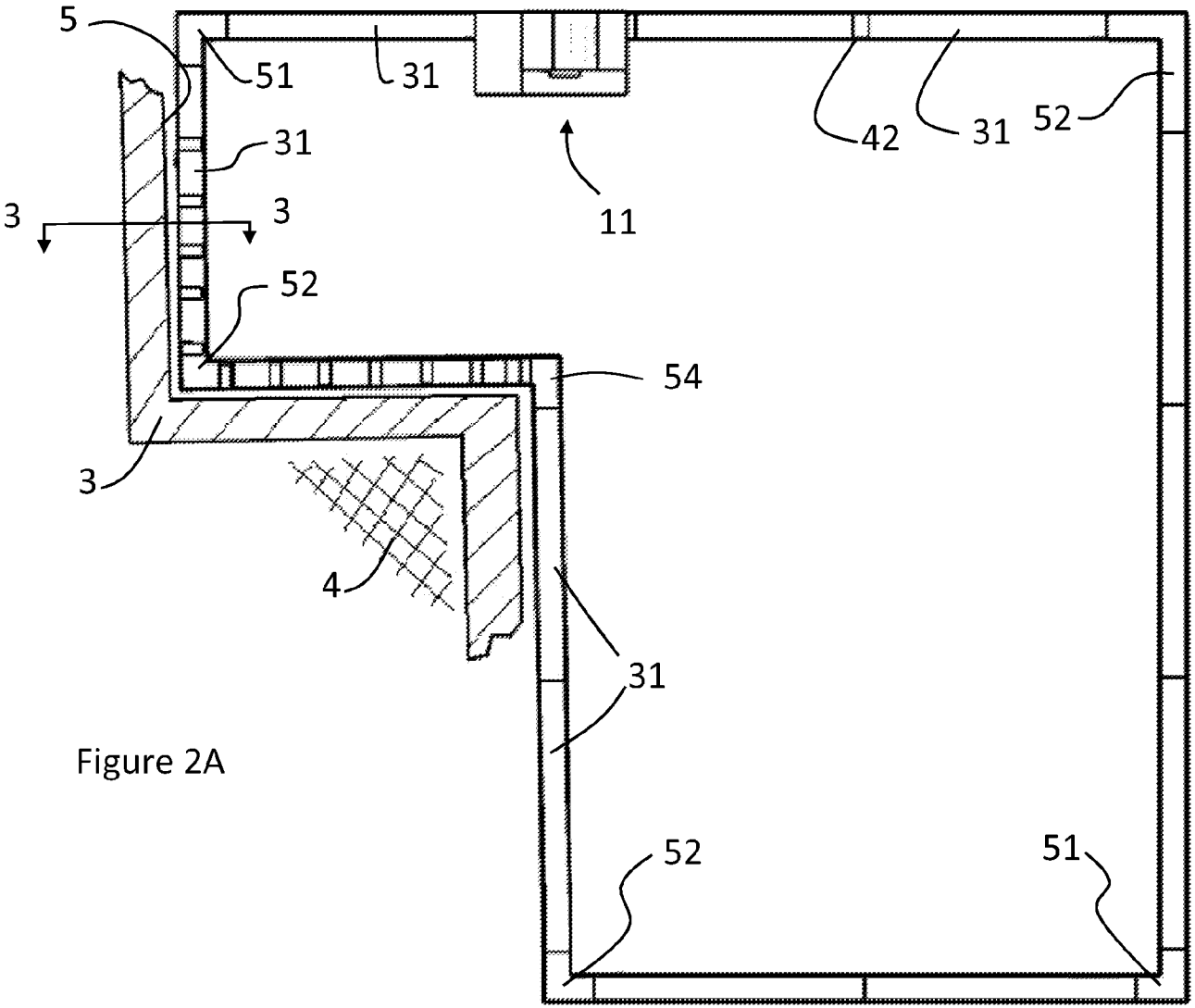
FIG. 2A shows a plan view of the layout of a basement installed with the water leakage control and air dehumidifying system.
Figure 2B:
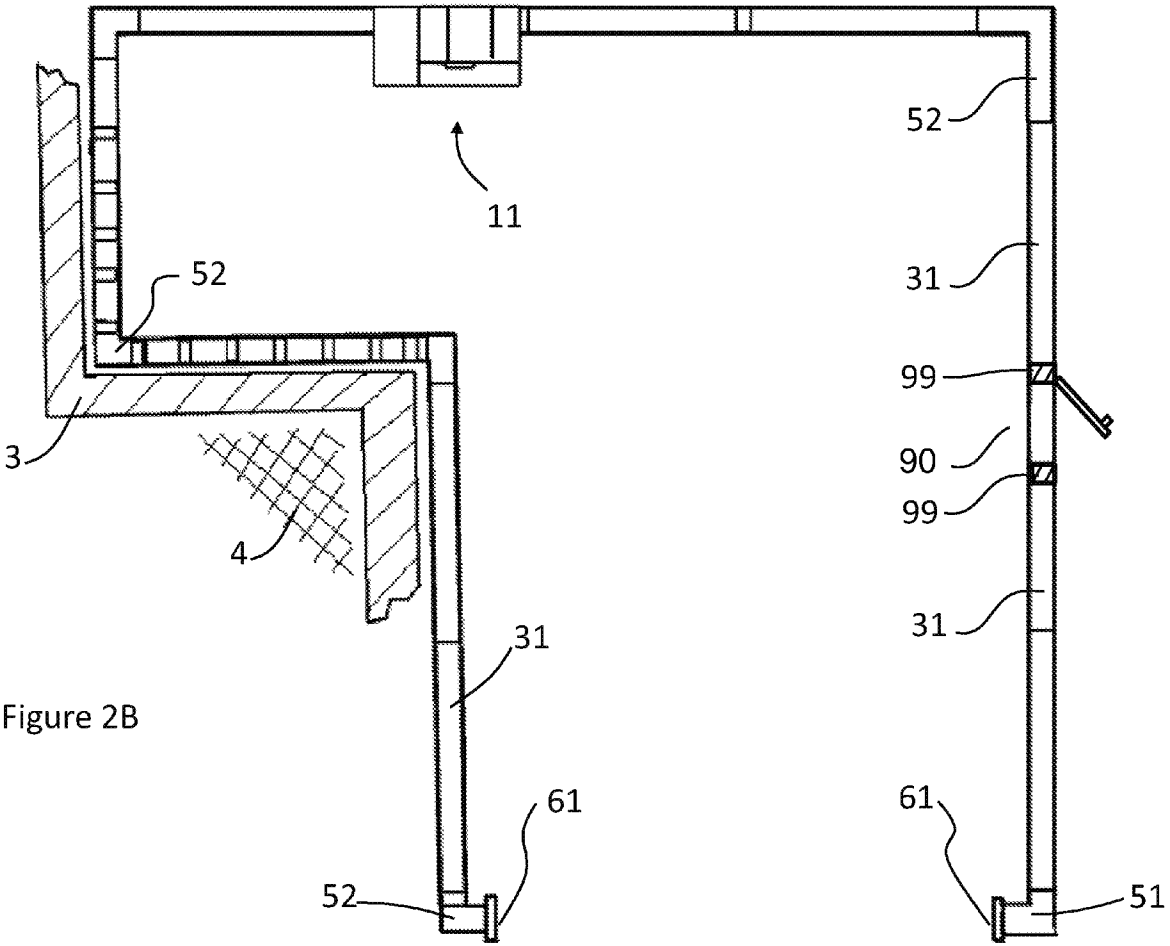
FIG. 2B shows a plan view of the layout of a basement installed with an alternative embodiment of the water leakage control and air dehumidifying system.
Figure 3:
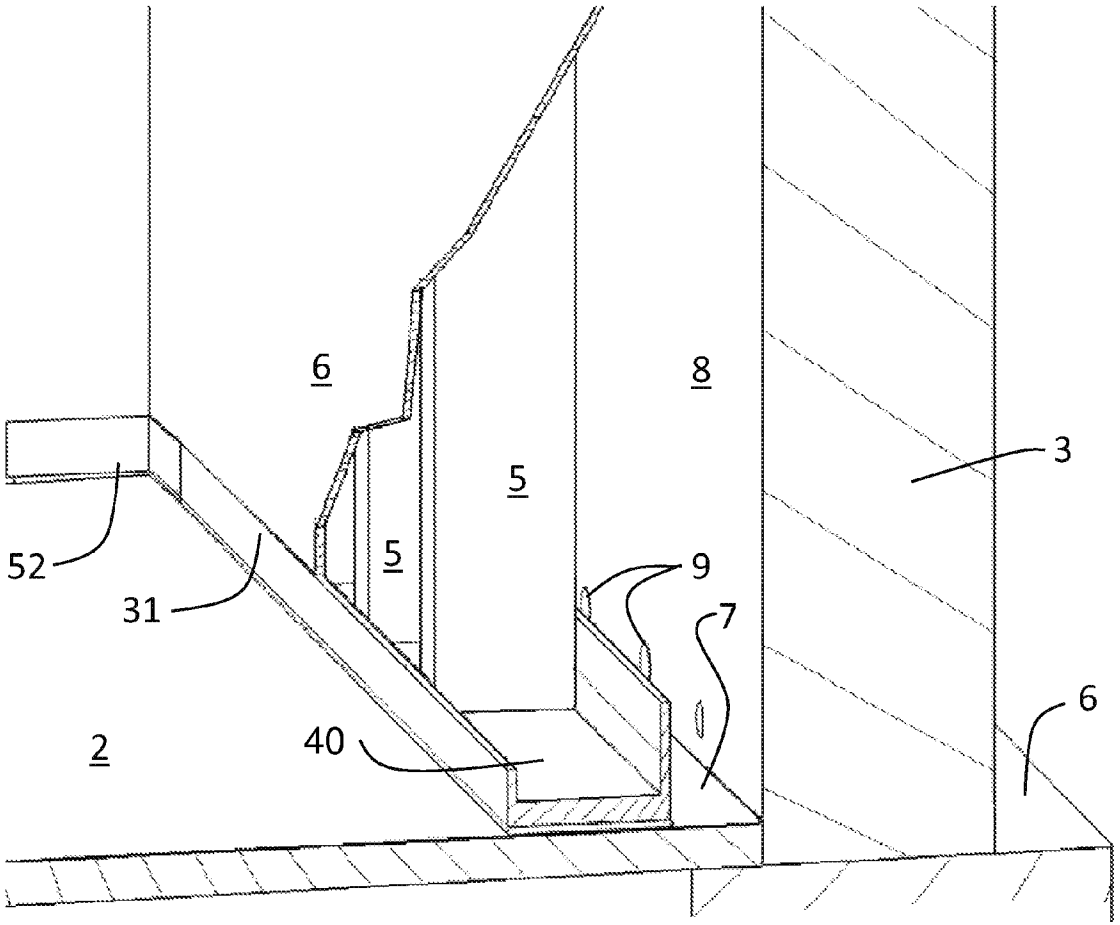
FIG. 3 shows a sectional view of the water and air channeling device installed in the basement with a fabricated interior wall.
Figure 4:
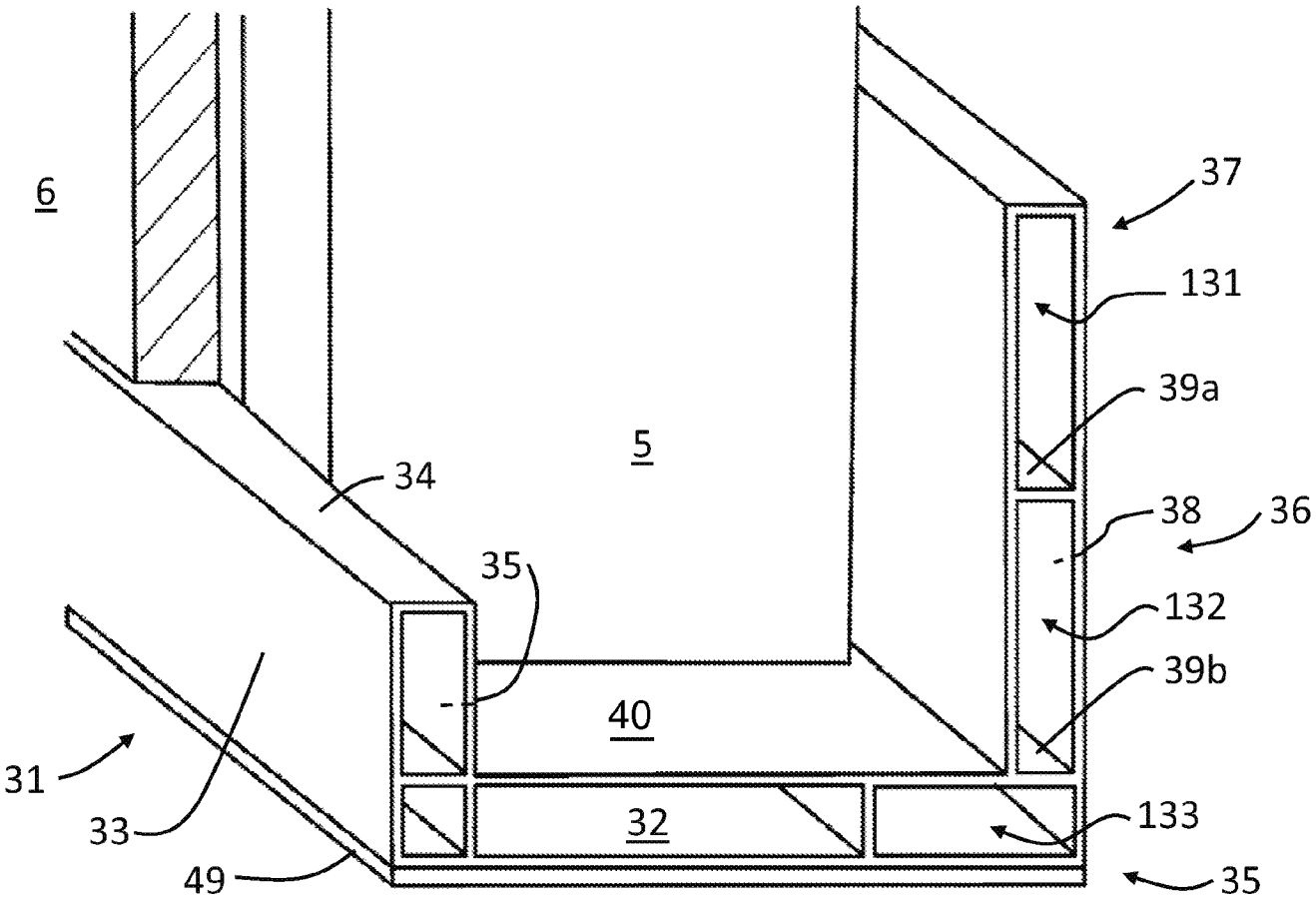
FIG. 4 shows a detailed cross section of the water and air channeling device shown in FIG. 3, including channels for conducting water leakage, humid air and dehumidified air.

The water and air channeling track system 30 includes straight sections 31 of any length and outside corner (or elbow) sections 51 and 52 to form a closed track system. An optimal union 42 can be used to provide support and strength at the joint of the straight sections 31 and corner sections 51,52. These various sections can be sized and arranged into any pattern, with the various straight sections 31 and corner sections 51,52 coupled together. As shown in FIG. 2B, the water and air channeling track system 30 can also be arranged in an open track system, where one or more of the track sections can be removed and the ends of the remaining track sections 31 closed off with a cap section 61.

Figure 13:
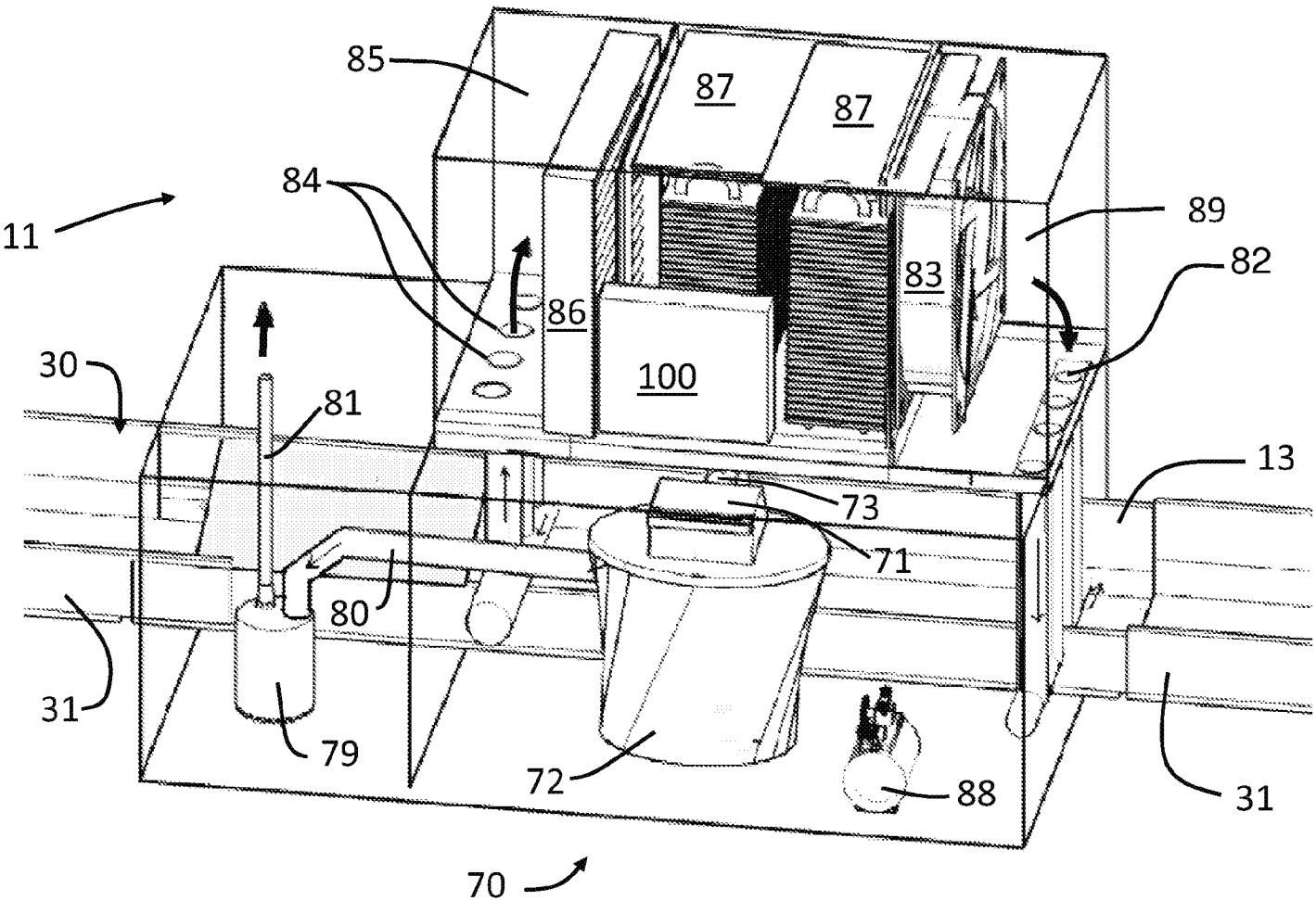
FIG. 13 shows an elevation view of a modular water leakage control and air dehumidifying apparatus that includes an air dehumidifying apparatus, an air channel manifold with a humid air inlet port and dehumidified air outlet port, a water vacuuming apparatus, and a water channel manifold and vacuum inlet port.

The fluid-conducting piping is fluidly connected to a manifold section 13 of the module, shown in FIG. 13. The manifold section 13 extends through both sides of the module 11, where the manifold section 13 is connected to the water and air channeling track system 30. The module 11 containing the water vacuuming apparatus 70 is positioned at the lowest grade position in the basement to maximize gravity flow of excess water leakage to the water collection system.

The components of the water and air channeling track system 30 are typically made of an extruded plastic, including polyvinylchloride (PVC) and acrylonitrile-butadiene-styrene (ABS), and the respective component sections are easily assembled and joined using PVC/ABS joint sealant. The components can also be made of a pultruded fiberglass-resin, with the respective component sections are easily assembled and joined using suitable joint bonding and sealant agents.

As shown in FIGS. 4-10, the straight sections 31 and outside corner sections 51,52 have a multi-channel structure, and includes a flat bottom 32, a front wall 33 having a top sill 34 and a face 35, a rear wall 36 having an inner face 37 and an outer face 38, and an upper partition 39*a* and a lower partitions 39*b* that divide the space within the rear wall 36 into a plurality of fluid channels, including an upper air channel 131, a lower air channel 132, and a water channel 133. An intermediate base 40 disposed between the inner face 35 of the first wall 33 and the inner face 37 of the rear wall 36 defines a base and a trough for positioning and securing of structural members, such as wooden studs 5. The design, materials and construction of the air and water channeling components can be sufficiently sturdy to be used both with interior finished walls as well as outer or interior load bearing walls.

The device 31 is secured to a floor 2 in a water-tight fashion with a water-proof adhesive or a foam seal layer 48 by a securement, such as a bolt or nail driven through the device structure. The top sill 34 supports a finished wall paneling 6 (commonly known as drywall) which can then be secured to the studs 5, keeping the bottom of the paneling up off of the floor.

Figure 5:
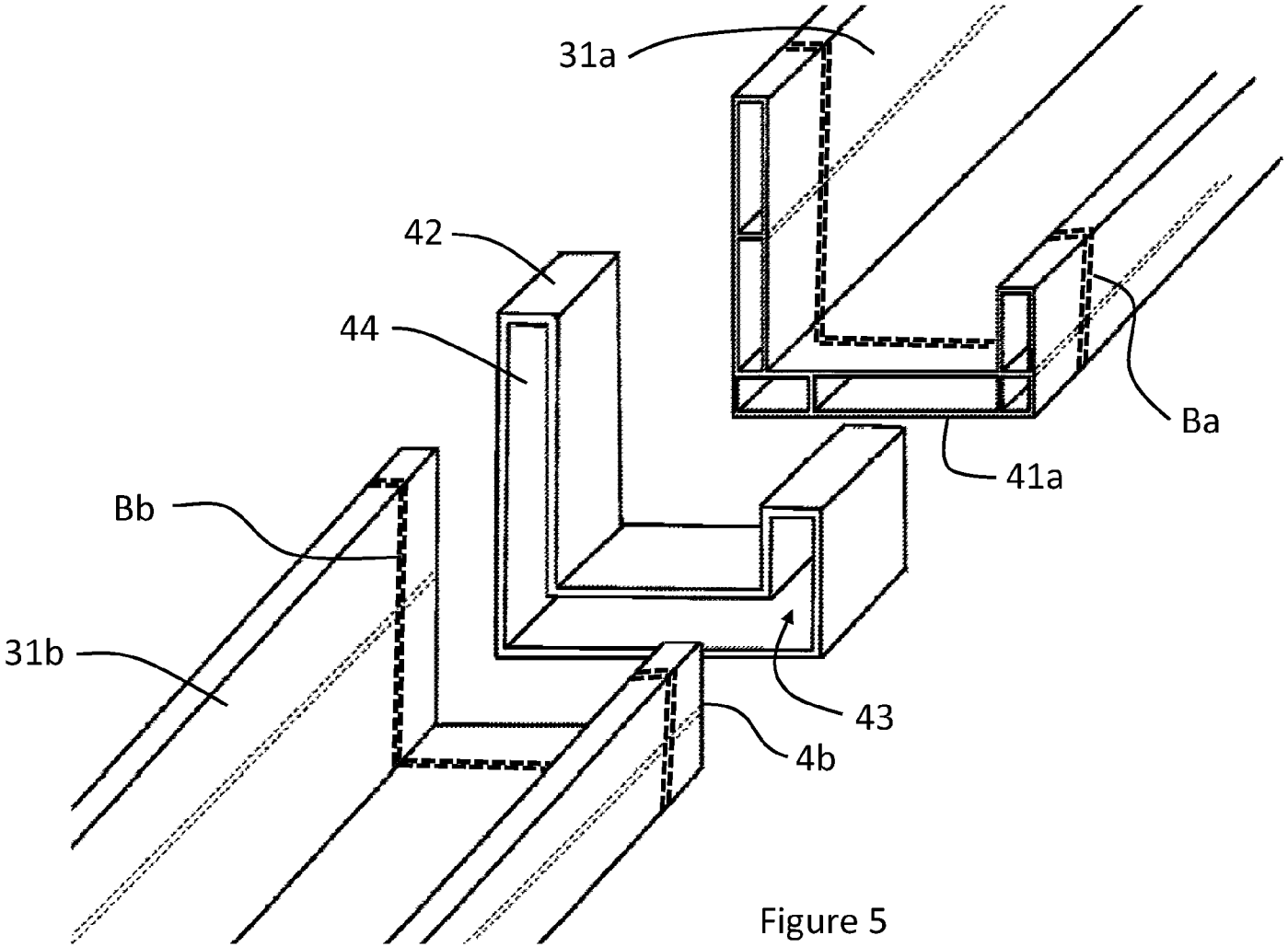
FIGS. 5-7 show a union and two straight sections of the water and air channeling device that are to be joined.
Figure 6:
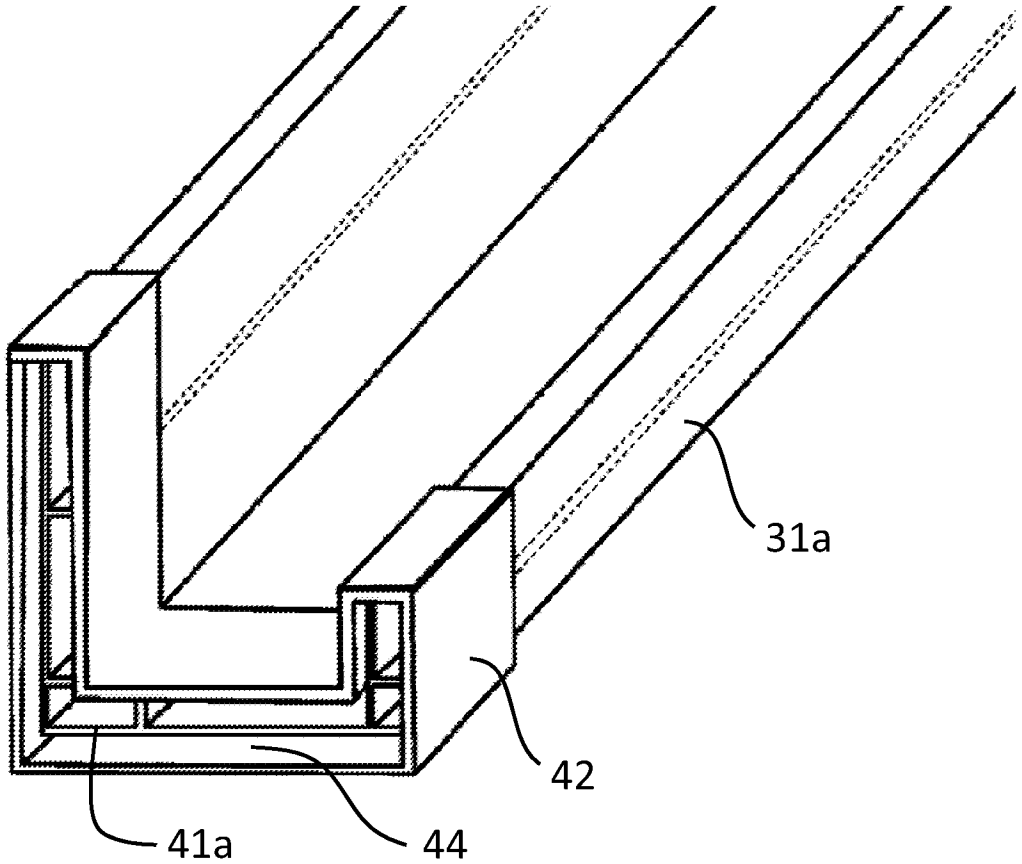
Figure 7:
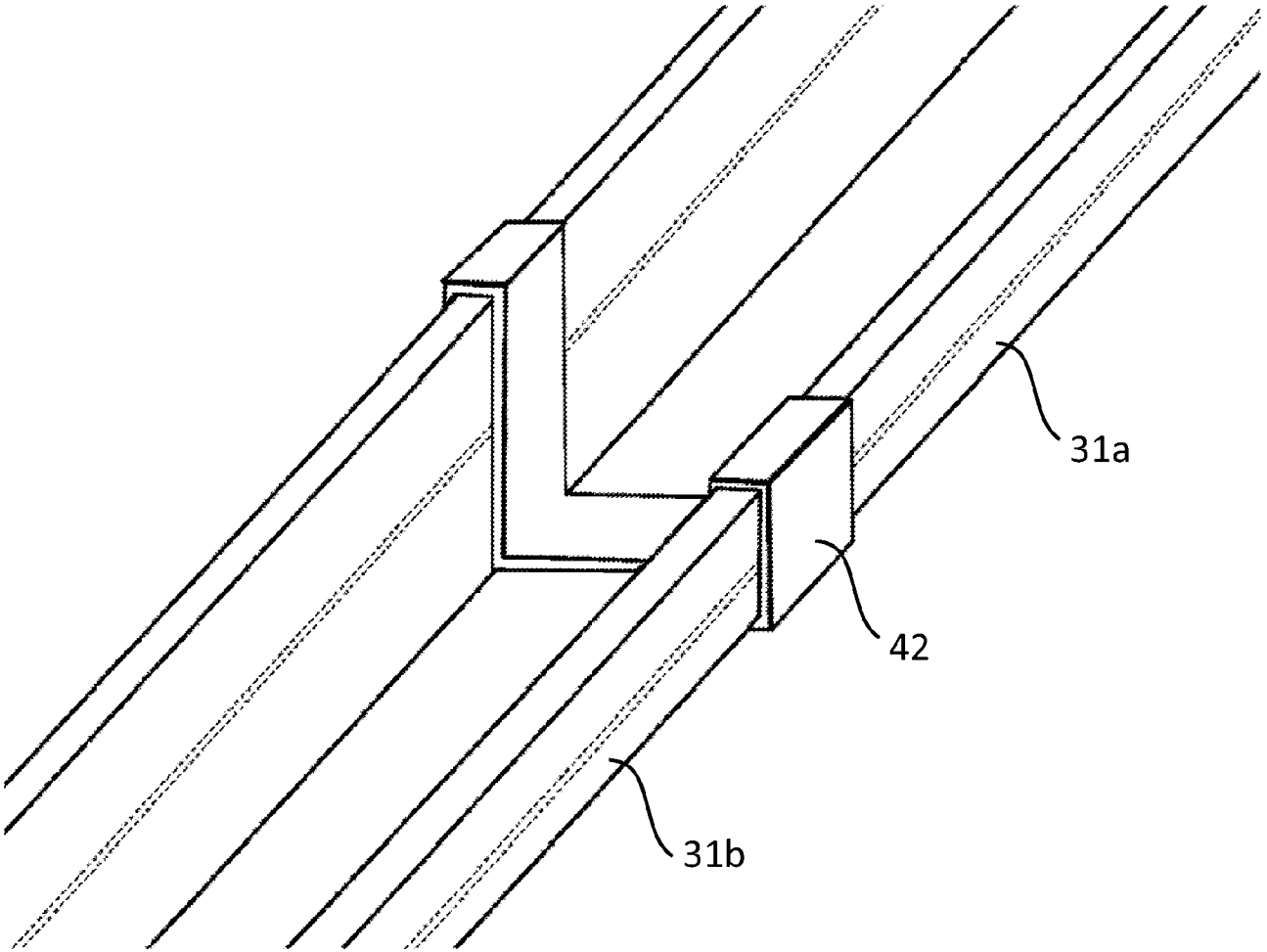

As shown in FIGS. 5-7, two lengths of straight section 31 can be cut to desired length and joined together to make a linear multi-channel device of varied length. A union 42 can be used to join to assist joining of two straight sections lengths. The union 42 having a single through opening 43 of the shape and dimensions of the outer periphery of the cross-section of the straight section 31, and is defined by an inner peripheral wall 44 provides a sliding but frictional fit with the corresponding outer surfaces of the straight section 31.

Assembly is made by first applying a bead (Ba) of a suitable adhesive or epoxy to the outer surfaces of a first straight section 31*a*, just inboard of the edge rim 41*a*. Then the union 42 is slipped over the edge rim 41*a* so that the straight section 31 extends about half way through the opening 43 and seals to the inside wall 44 of the union 42. Adhesive or epoxy is then applied inside the union 42 and on all surfaces of the edge rim 41*a*, and as a second bead (Bb) on the outer surfaces of a second straight section 31*b*, just inboard of the edge rim 41*b*. The second straight section 31*b* is then inserted into the union 42 and pressed against the first straight section 31*a* until the adhesive or epoxy hardens or cures, so that the respective edge rims 41*a*,41*b* are sealed.

Various other means of securing sections of the fluid channel together can be used, including a sleeve inserted between respective air channels 131 and 132 and water channel 133 of the respective straight sections 31, provided that there is no leakage of air or water from and between the respective air and water channels.

Figure 8:
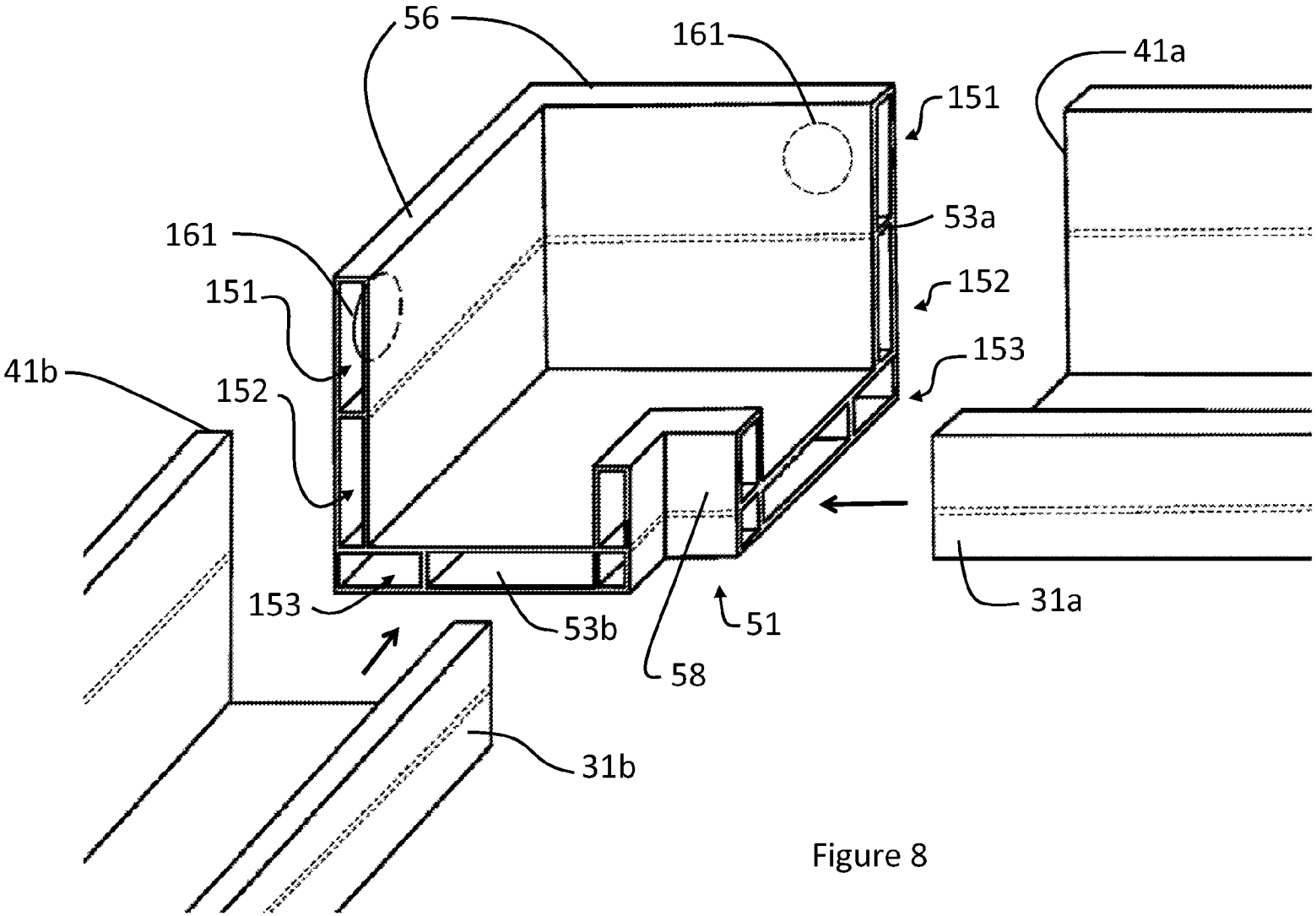
FIG. 8 shows an outside corner section and two straight sections of the water and air channeling device that are to be joined.
Figure 9:
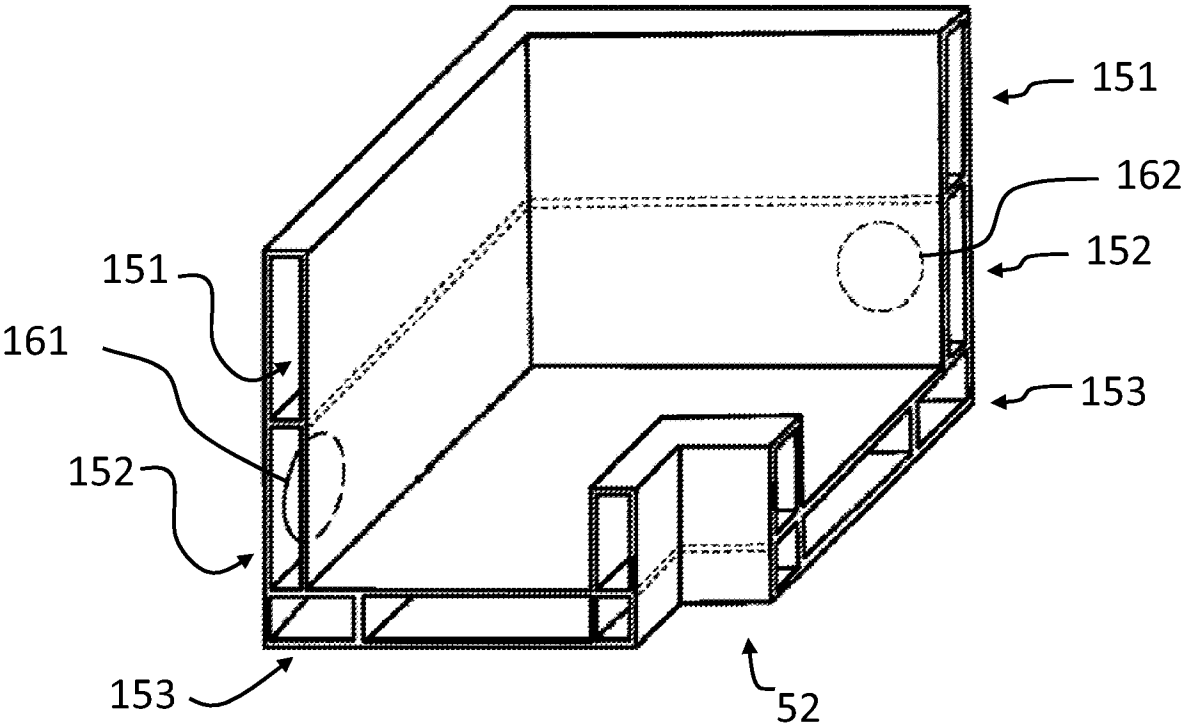
FIG. 9 shows an outside corner section having the air opening in the upper air channel.

In a similar fashion, a straight section 31 can be sealingly joined to a corner section 51 or 52 as shown in FIGS. 8-9. The edge rims 41*a* and 41*b* of the first straight section 31*a* and the second straight section 31*b* are fluid-sealed to the corresponding edge rims 53*a* and 53*b* of the corner section 51. Although not shown, a union 42 can be used to join and help secure the straight section-corner section joint.

Outside corner section 51 shown in FIG. 8 and outside corner section 52 shown in FIG. 9 provide dedicated air movement between the channel system and the air space behind the finished wall panel 6, of both the humid air behind the wall and dehumidified (treated) air. The corner section 51 shows an air opening 161 near each end of the air channel 151 that passes through the upper section of the outer wall 56. In an embodiment of the invention, the upper channel 131 of the straight section 31 and the upper channel 151 of the corner section 51 or 52 conduct the humid air, while the lower channels 132,152 conduct the dehumidified air that has been treated. Openings 161 in the upper channel 151 of the corner section 51 provides intake of humid air from the air space 7 behind the finished wall panel 6, while the opening 162 in the lower channel 152 of the corner section 52 (FIG. 9) provides distribution of the dehumidified air from the dehumidifying unit to the air space 7.

Figures 11A, 11B:
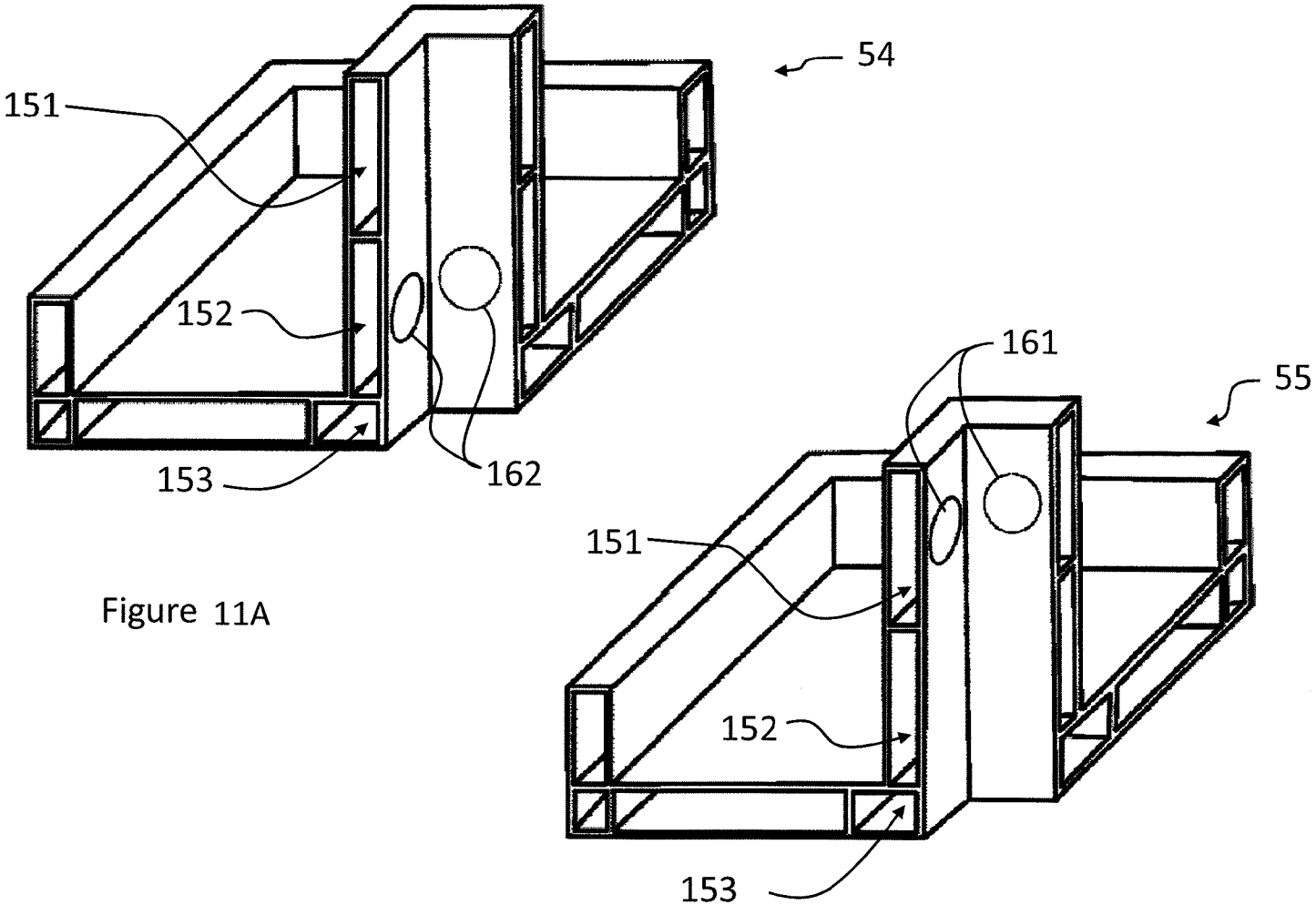
FIGS. 11A and 11B show inside corner sections having the air opening in the lower air channel and the upper air channel, respectively.

FIGS. 11A and 11B show inside corner sections 54 and 55, respectively, that have the air openings 162 and 161 in the lower and upper air channels, respectively.

Although not shown, a corner section can also have no openings in either the upper air channel 151 or the lower air channel 152. Alternatively, air openings can be provided in the upper channels and lower channel of the straight sections 31, as desired.

Figure 10:
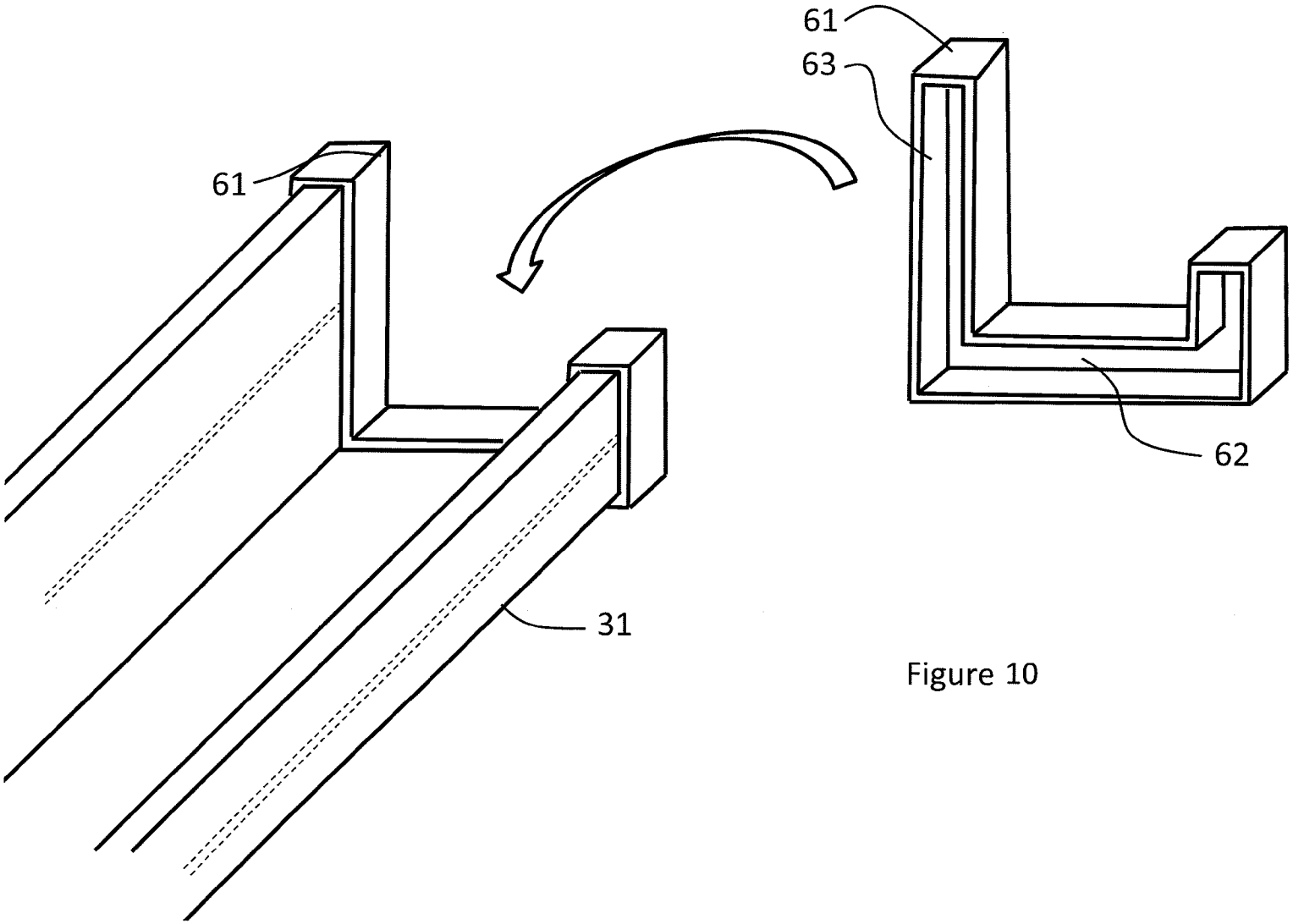
FIG. 10 shows a cap piece for capping an end of a straight section of the water and air channeling device.

In a layout of the system where a dead end leg is used, as shown in FIG. 2B, a cap member 61 can be sealed to the end of the straight section 31 as shown in FIG. 10. The cap 61 has a peripheral wall 63 and a back wall 62 that define a cavity 64 that is shaped and dimensioned to provide a frictional sliding fit over the end of the straight section 31, for sealing each of the air and water channels.

Figure 12:
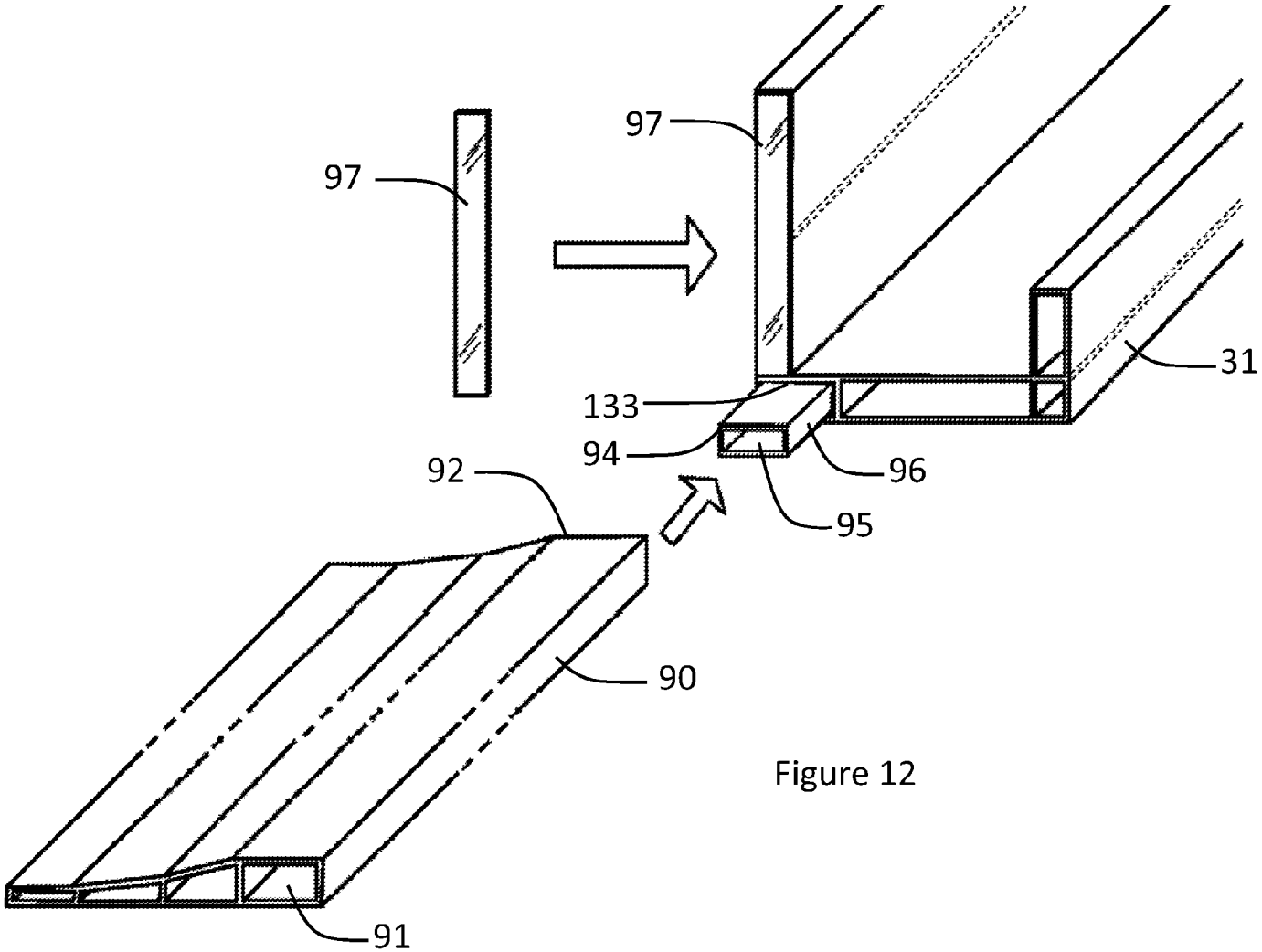
FIG. 12 shows a threshold channel section for use as a door threshold, for passing the track system below a door and its door frame.

As also shown in FIG. 2B, the water and air channeling system can also include a channel section 90 for use as a door threshold, for passing the track system below a door 98 and its door frame 99. The water-only threshold channel section 90, shown in FIG. 12, includes a water channel 91 passing the length through. The width of the threshold channel section 90 can be cut for the particular width of the door 98 and door frame 99. The extruded channel section 90 can be tapered to match conventional door thresholds. One end of a connecting sleeve 94 with opening 95 therethrough can be sealingly inserted and fixed into the water channel 133 of the straight section 31, and then the other end 96 inserted and sealed into the water channel 91 at end 92. In this embodiment, the two air channels 131 and 132 of the straight section 31 can be capped or blocked on both sides of the door frame 99 opening with cap means 97. Alternatively, an opening can be made into the back wall of either of the two air channels 131 or 132 of the straight section 31, so that the dehumidified air can pass over and around the opening for the door frame 99.

<Water Vacuuming Apparatus>

Figure 14:
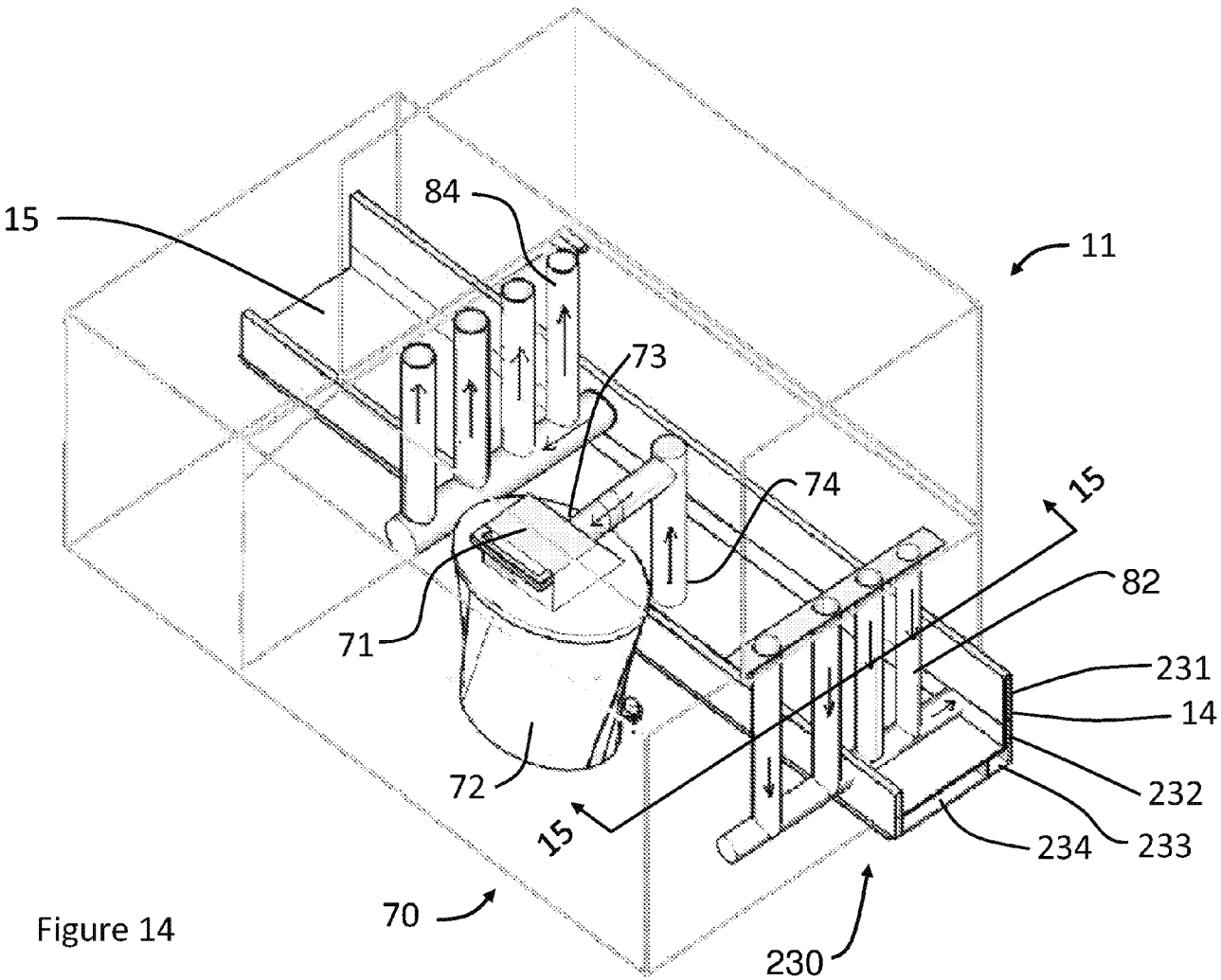
FIG. 14 shows only the water vacuuming apparatus, and the air and water channel manifolds.
Figure 15:
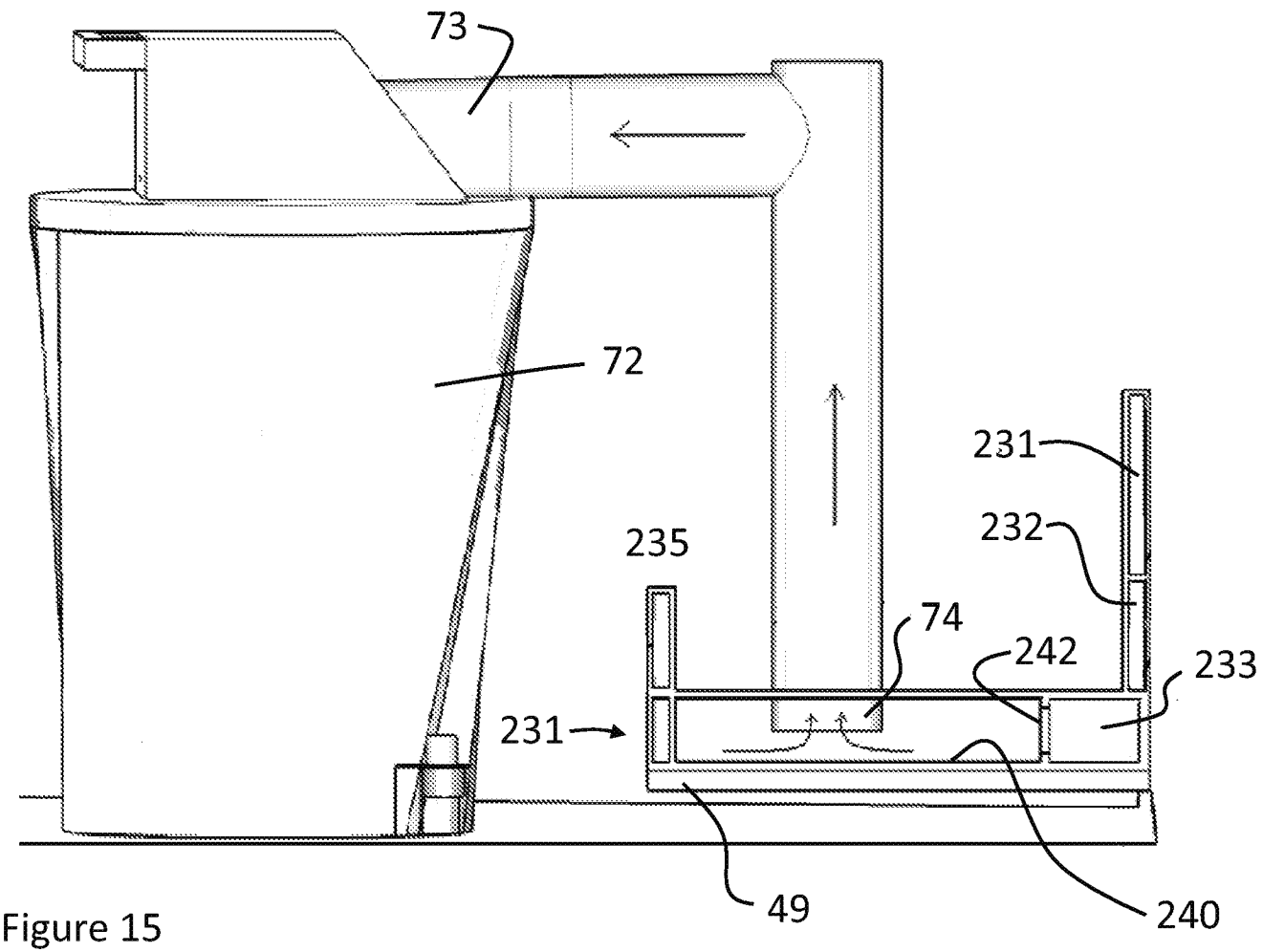
FIG. 15 shows an elevated cross section of the air and water channel manifold taken through line 15-15 of FIG. 14.
Figure 16:
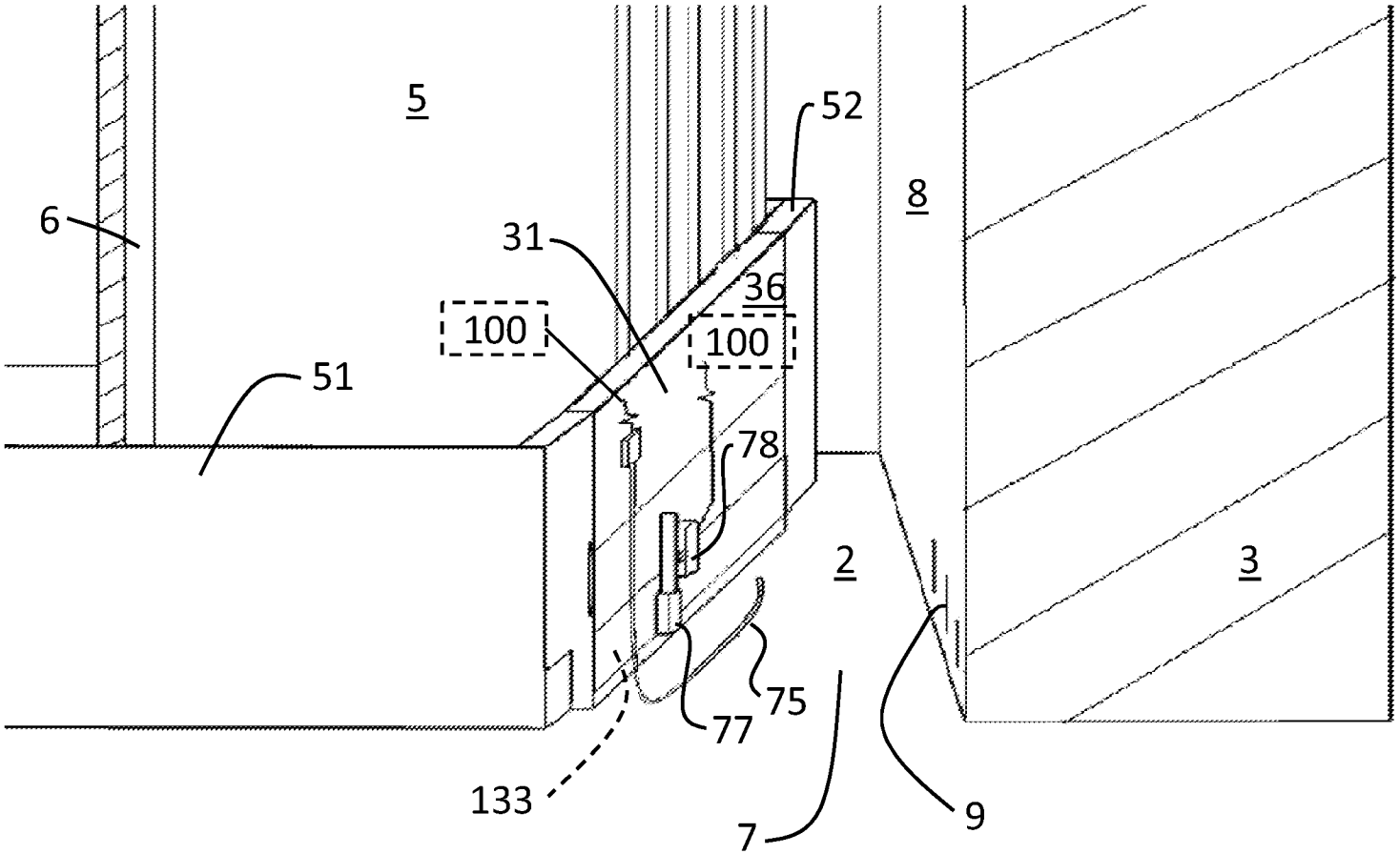
FIGS. 16 and 17 show the back side of the water and air channeling device, showing a door and an opening through which water leakage can be drawn into the water and air channeling device.

The module 11 shown in FIG. 13 includes the water vacuuming apparatus 70, which includes mechanical, electrical and electronic control devices for exerting a vacuum, collecting water leakage delivered to the manifold unit 13 by the water and air channeling track system 30, and discharging excess collected water leakage from the basement. FIG. 14 is a more detailed view of the vacuum unit, while FIG. 15 is a sectional view of a manifold unit 230. A vacuum unit 71, for example a Ridgid WD1450 14-Gallon 6-Horsepower Wet/Dry Vacuum, draws a slight vacuum on an inflow side and is directed toward and sealingly mounted onto the top of a sealed collecting container 72 that itself can withstand the slight vacuum. The manifold unit 230 is built integrally with the module 11 with corresponding upper air channel 231, lower air channel 232, and water channel 233. As shown in FIG. 15, water channel 233 communicates with vacuum channel 235 via port 242, which is sealed from the opening 234 at both inlet ends 14 and 15 of a manifold unit 230. An inlet port 73 of the collecting container 72 is fluidly connected by piping to the water leakage port 74 of the vacuum channel 235. The inlet opening of the water leakage port 74 is positioned a distance from the bottom floor 240 in the vacuum channel 235 to effectively draw in any water collected in the unit. The water vacuum unit 70 also includes a vacuum controller unit 100 that controls the detection of leakage, the turning on and shutting off of the system, and alarms and notifications of water leakage events. The vacuum controller unit 100 is in electronic communication with one or a plurality of leakage detectors 75 positioned along the periphery of the track system 30 (as shown in FIG. 16), to receive a water leakage detection signal when water leakage invades the floor space between the device 31 and the basement wall 3. An example of a leakage detector is the Tracetek™ TT1000 water-sensing cable (Raychem Corp., Menlo Park, Calif.), which can detect the presence of water at any point along its length. The location of the leakage can be identified and an alarm triggered using associated TraceTek™ locating module and alarm.

Figure 17:
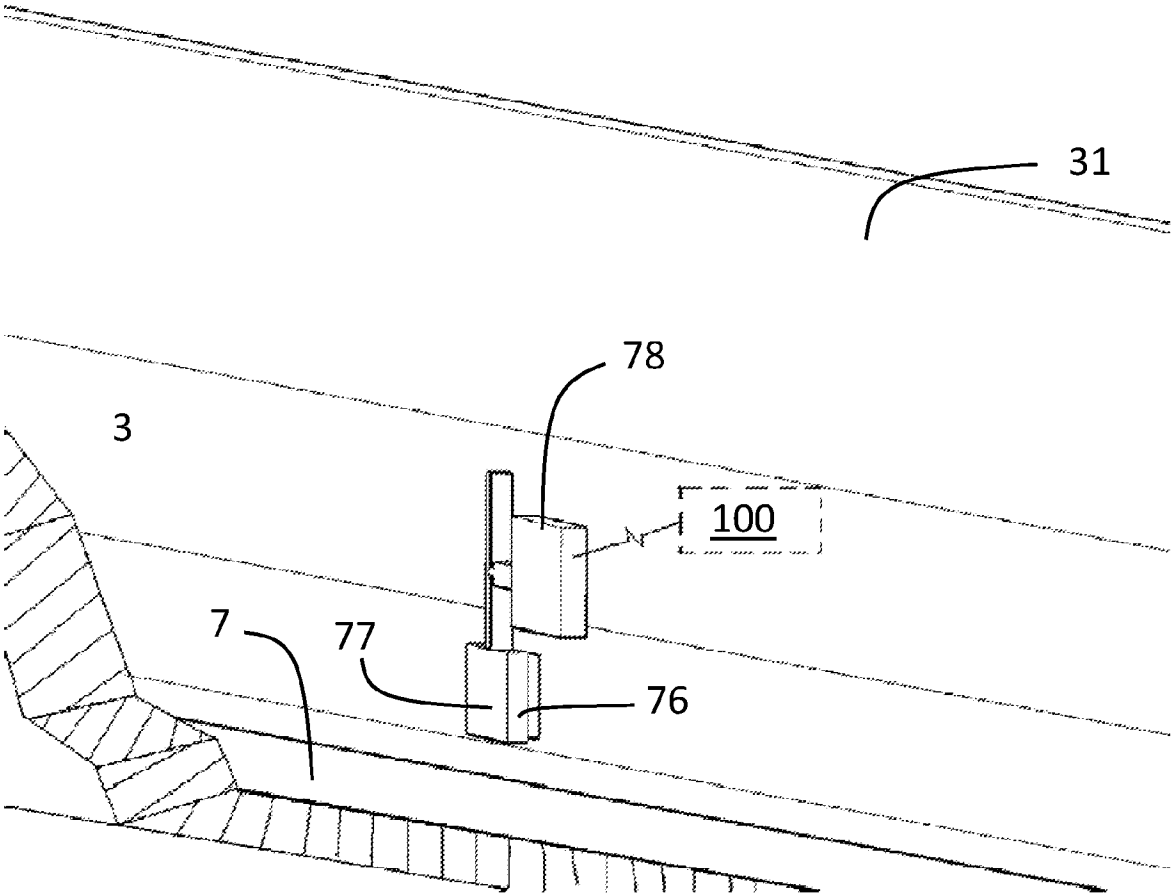

The water leakage detecting and control system optionally can include a means for limiting entry of water leakage into the perimeter channel system to the one or more locations where water leakage has been detected. In most basements, excess water leakage typically occurs along only one or two walls, but seldom along all walls. As shown in FIGS. 16 and 17, the water leakage channels 133 (not shown) in the rear wall 36 of the straight section 31 includes a lower aperture 76 into the water leakage channel 133, through which water leakage can flow by gravity when water leaks through weep holes 9 that have been made in the basement wall 3 along the floor 2. The leaking water collects on the floor in the space 7 between the basement wall 3 and the device 31. In a preferred embodiment, a closure, shown as a door 77, closes and preferably seals the aperture 76 unless excess water leakage through the basement wall 3 is detected by the leakage detector 75 in the vicinity. A spring or other means (not shown) typically biases the door 77 toward closure. The leakage detector 75 is in electronic communication with the controller unit 100, which electronically powers and controls the door 77 to open and uncover the aperture 76. The leakage detector (s) 75 are positioned around the periphery of the basement to detect and identify the particular location when leakage occurs. Controller 100 signals a particular actuator 78, such an electronic solenoid, to open a particular door 77 in the vicinity of the location where leakage has been detected. Operation of the water vacuuming apparatus 70 targets the drawn-in air through the particular aperture 76 only in the vicinity of the location where leakage has been detected, and thereby maximizes the effect of the vacuum to draw the excess water leakage to collection container 72.

The module 11 also includes a water discharge unit 79, which includes mechanical, electrical and electronic control devices for discharging excessive amount of water leakage and condensate moisture from the basement 1. Vacuum container 72 collects and fills with leakage water and condensate, and is provided with a means for discharging the excess water via a sump pump 79, for example a BWSP 1730 (GPH @ 10'), available from www.basementwatchdog.com. As shown in FIG. 1, an overflow line 80 discharges excess water into a conventional, above-grade sump pump unit 79, which discharges the excess water from the basement through line 81 by well known means. Alternatively, vacuum container 72 can include an integral sump pump (not shown) that periodically pumps collected water from the container 72 into the sump pump unit 79.

The components of the module are housed in one or more compartments of a station made from welded foam cored PVC or other suitable construction materials.

<Air Dehumidifying Apparatus>

The module 11 also includes the dehumidifying apparatus 14, which includes mechanical, electrical and electronic control devices for drawing air from an air space 7 around the periphery of the track system between the basement wall 3 and the finished wall panel 6, dehumidifying the drawn air, and distributing the dehumidified air back to the air space 7. An air fan 83, for example an 11" DC 1424 cfm axial fan (marine grade) ignition proof 12 or 24 volt, made by Delta, draws humid air from the space 7 along the periphery of track system 30 in through one or more air port or opening in an air distribution section of the track system 30. In the illustrated embodiment, the air distribution section is a corner section 52 that includes the air port 162 in the lower channel 152. As can be ascertained from the Figures, the lower channel 152 of the corner section 52, the lower channel 132 of the straight section 31, and the lower air channel 232 of the manifold unit 230 are configured to distribute treated, dehumidified air to the air space 7 behind the finished walls 6 to the dehumidifying apparatus 14. The humid air is drawn into the upper air channel 231 of the manifold unit 230 through one or more humid air distribution channels 84 to a humid air plenum 85. The humid inlet air is first filtered (typically, with a replaceable HEPA air filter 86) and then passed across the chilled condensing coils and vanes of condenser unit 87 typically made of brazed copper coils, and including coolant compressor 88, for example, an RT hermetic compressor, made by Copeland. Excess moisture in the humid air condenses on the coils and collects below the condenser 87, and flows under gravity into the container 72. The dehumidified air then passes through the fan 83 and is blown through air outlet plenum 89, and through one or more dehumidified air distribution channels 82 and into the lower channel 232 of the manifold unit 230. As can be ascertained from the Figures, the lower channel 232 of the manifold unit 230, the lower air channel 132 of the straight section 31 and the lower air channel 152 of the corner section 52, are configured to discharge the dehumidified air into the air space 7 behind the finished walls 6. As shown in FIG. 1, the humid air intake corner section 52 is spaced away from the dehumidified air discharge corner section 51 to promote movement of the humid air toward the air intake.

The dehumidifying apparatus 14 is controlled to turn on and shut off by a humidity controller unit 100*b*, which receives humidity detection signals from one or a plurality of humidity detectors 75 disposed along the periphery of the track system 30 within the air space 7. An example of a humidity detector is a THS-W temp/humidity sensor (Monarch Instruments), which can detect the relative humidity of the air in the detected air space, and communicate such information with the humidity controller unit.

The dehumidifying apparatus can be programmed to discontinue dehumidifying operation when excessive water leakage is being vacuumed through the water leakage channels by the water vacuuming apparatus 70. Humidity levels would be understandably high and sustaining during periods of time when excessive water is leaking into the basement.

After positioning the module 11 at the lowest grade position in the basement, the sections of the track system 30 are laid out into the desired pattern with the track system sections position in close proximity to the basement wall 3, leaving a small gap 7 from the track system to the wall 3. The sections of the track system are secured to the basement floor 2 with a continuous closed cellular foam 49 on the bottom side of the track sections to form a water-tight seal with the floor, such that any leakage between the basement wall and the track system will drain into the water leakage channels 133 of the straight sections 31.

The invention claimed is:

1. A system for controlling water leakage and excess humidity in a basement, including:

a. a water leakage vacuum apparatus that includes a water vacuuming apparatus to collect a water leakage through a basement wall, b. an air dehumidifying apparatus, and c. a perimeter channel system disposed along a perimeter of the basement wall having a plurality of flow channels including a water channel for conducting the water leakage away from the basement wall to the water vacuuming apparatus, a humid air channel for communicating humid air from an air space proximate to the basement wall to the dehumidifying apparatus, and a dehumidified air channel for communicating the dehumidified air discharged from the dehumidifying apparatus to the air space proximate to the basement wall.

2. The system according to claim 1, further including a water leakage detector positioned along the basement floor along the perimeter, and between the basement wall and a portion of the water and air channeling device, for detecting the water leakage, and communicating a signal to the water leakage vacuum apparatus.

3. The system according to claim 2, further including a means for limiting entry of the water leakage into the perimeter channel system to only the one or more locations where the excess water leakage has been detected.

4. The system according to claim 3, wherein the means for limiting entry of the water leakage into the perimeter channel system includes an opening into the water channel, and a selectably openable door that sealingly closes over the opening, and that moves from a closed position to an open position in response to water leakage signal communicated to the water leakage vacuum apparatus.

5. The system according to claim 1, further including an above-floor sump to discharge the collected water leakage.

6. The system according to claim 1 wherein the perimeter channel system comprises a plurality of connected water and air channeling devices that are configured for attachment to a floor of the basement.

7. The system according to claim 6, further including a humidity detecting and control system including the air dehumidifying apparatus and an air moving apparatus, for drawing air in a draw space along the perimeter channel system to the air dehumidifying apparatus, and returning the dehumidified air to a return space along the perimeter channel system.

8. The system according to claim 7, further including a humidity detector for detecting the humidity of the air in the draw space, and communicating a signal to the humidity detecting and control system.

9. The system according to claim 6, further including a control and network system for monitoring the water leakage and air humidity, for collecting and recording data on water leakage and air humidity, and for programming and controlling the air dehumidifying apparatus and the water leakage vacuum apparatus.

10. The system according to claim 9 wherein the control and network system is networked with the internet.

11. The system according to claim 6 wherein the perimeter channel system includes a plurality of corner sections and a plurality of straight sections, sealingly connected to form a selected pattern.

12. The system according to claim 11 wherein an opening in the humid air channel is formed into a first corner section, and an opening in the dehumidified air channel is formed into a second adjacent corner section.

13. The system according to claim 6, further including an electrical power backup device.

14. The system according to claim 6 wherein the plurality of connected water and air channeling devices have a base surface upon which an interior wall is constructed, wherein the air space is defined between the basement wall and the interior wall.

15. The system according to claim 14 wherein the base surface is configured to retain the wooden studs used for constructing the interior wall.

16. The system according to claim 15 wherein the plurality of connected water and air channeling devices have a rear wall disposed facing the basement wall, the rear wall having the bottom water channel, and an upper air channel and an intermediate air channel, the upper wall channel and the intermediate air channel defining the humid air channel and the dehumidified air channel.

17. The system according to claim 16 wherein the plurality of connected water and air channeling devices have a front wall disposed facing away from the basement wall, the front wall comprising a surface configured to support a drywall panel.

* * * * *